US005219158A

United States Patent [19]

Kilian et al.

[11] Patent Number: 5,219,158

[45] Date of Patent: Jun. 15, 1993

[54] TWO CORNER SHEET STACKING APPARATUS WITH MATCHING COVER

[75] Inventors: Leslie R. Kilian, Fairport; Richard F. Scarlata, Rochester; Kenneth F. Blanchard, Walworth, all of N.Y.

[73] Assignee: Xerox Corporation, Stamford, Conn.

[21] Appl. No.: 952,241

[22] Filed: Sep. 28, 1992

[51] Int. Cl.[5] ..... B65H 31/22

[52] U.S. Cl. ..... 271/207; 271/213; 271/145

[58] Field of Search ..... 220/4.01; 414/789.9; 271/145, 162, 207, 213, 223, 157

[56] References Cited

U.S. PATENT DOCUMENTS

| | | | |
|---|---|---|---|
| 3,290,020 | 12/1966 | Findley | 220/4.01 |
| 3,543,926 | 12/1970 | Campbell | 271/207 |
| 3,747,920 | 7/1973 | Linkus . | |
| 4,318,322 | 3/1982 | Russell | 271/207 |
| 4,359,218 | 11/1982 | Karis . | |
| 4,423,995 | 1/1984 | Karis . | |
| 4,431,177 | 2/1984 | Beery et al. . | |
| 4,477,218 | 10/1984 | Bean . | |
| 4,479,641 | 10/1984 | Bean et al. . | |
| 4,504,053 | 3/1985 | Shiozawa | 271/157 |
| 4,556,210 | 12/1985 | George | 271/157 |
| 4,750,729 | 6/1988 | Kanoto et al. | 271/162 |
| 5,017,972 | 5/1991 | Daughton et al. . | |
| 5,018,717 | 5/1991 | Sadwick et al. . | |
| 5,023,658 | 6/1991 | Toyama et al. | 271/145 |
| 5,069,598 | 12/1991 | Kleinhen et al. | 271/207 |

FOREIGN PATENT DOCUMENTS

| | | | |
|---|---|---|---|
| 95574 | 12/1983 | European Pat. Off. | 271/207 |
| 230958 | 12/1984 | Japan | 271/207 |

*Primary Examiner*—Robert P. Olszewski
*Assistant Examiner*—Steven M. Reiss

[57] ABSTRACT

A two corner container for receiving copy sheets for stacking is positioned within a machine and allows viewing of stacking progress within the machine, as well as, the status of the container outside the machine. A two corner cover is provided that facilitates four corner protection and stacking capability for storing, stacking and transporting such containers.

10 Claims, 12 Drawing Sheets

TWO CORNER SHEET STACKING APPARATUS WITH MATCHING COVER

Cross-reference is hereby made to copending and commonly assigned U.S. Application Ser. Nos. 07/569,003, entitled DISK STACKER INCLUDING TRAIL EDGE TRANSPORT BELT FOR STACKING SHORT AND LONG SHEETS, filed Aug. 17, 1990 by Thomas C. McGraw et al. and Ser. No. 07/757,090, entitled TWO CORNER SHEET STACKING APPARATUS, filed Sep. 10, 1991 by Otto R. Dole, both of which are included herein by reference.

FIELD OF THE INVENTION

This invention relates generally to an electrophotographic printing machine, and more particularly concerns a two corner apparatus for stacking sets of copy sheets.

BACKGROUND OF THE INVENTION

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the change thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The tone powder image is then transferred from the photoconductive member to a copy sheet. The toner particles are heated to permanently affix the powder image to the copy sheet. The copy sheets are collected and bound or stapled together into sets of copy sheets. The bound or stapled sets of copy sheets are then stacked for presentation to the machine operator.

In commercial high speed printing machines of the foregoing type, large volumes of sets of copy sheets are fed onto a stacking tray. When the tray is loaded to its capacity, an elevator moves the tray to a station where an operator can readily remove the sets of copy sheets. Frequently, the printing machine is idling and not producing copy sets while the operator is unloading the previously completed sets from the stacker tray. This reduces the productivity time of the printing machine by increasing its down time. Ideally, high capacity printing machines should be run on a continuous basis and the unloading of copy sets should be such that the operator can simply and easily remove copy sheet sets from one sheet stacking apparatus while a new batch of copy sheet sets are being run into a second sheet stacking device. However, presently, most high speed printers use a single elevator maneuvered tray for receiving copy sheet sets, which is cumbersome for copy set removal, or use a single container and a pedestal to unlead copy sheet sets, for example, the Xerox ® 9700 printer. Also, previous high speed printers handled 8½×11" and 14" sheets with and without containers. There has also been a problem with stacking containers on top of each other in storage areas since the containers ordinarily do not come with covers. Accordingly, it is desirable for printing machines to have unloading while run capability and to be able to handle all sizes of copy sheets and all sizes of containers from B5 to A3 and stack the finished product with ease.

Various approaches have been devised for stacking and unloading sets of copy sheets. The following disclosures appear to be relevant:

U.S. Pat. No. 3,747,920
Patentee: Linkus
Issued: Jul. 24, 1973
U.S. Pat. No. 4,359,218
Patentee: Karis
Issued: Nov. 16, 1982
U.S. Pat. No. 4,423,995
Patentee: Karis
Issued: Jan. 3, 1984
U.S. Pat. No. 4,477,218
Patentee: Bean
Issued: Oct. 16, 1984
U.S. Pat. No. 4,479,641
Patentee: Bean et al.
Issued: Oct. 30, 1984
U.S. Pat. No. 5,017,972
Patentee: Daughton et al.
Issued: May 21, 1991
U.S. Pat. No. 5,018,717
Patentee: Sadwick et al.
Issued: May 28, 1991

The relevant portions of the foregoing patents may be summarized as follows:

Linkus discloses a sheet unloading apparatus used in conjunction with a punch press. A trolley moves material from a loading position to an unloading position. A support table receives sheets from the trolley and is vertically movable by a motor operated scissors type of support.

Karis (U.S. Pat. No. '218) describes a sheet collection and discharge system. Sheets continuously accumulate at a stacker station. A table supported for vertical movement on scissor type collapsible legs receives the sheets. The lower ends of the legs have rollers for traversing the apparatus across linear tracks. The table has a base platform element, the under surface of which is formed with connection pieces to which the upper ends of the support legs are attached. A series of spaced apart columns extend vertically from the upper surface of the table platform. Each column is generally rectangular with a longitudinal axis parallel to the longitudinal axis of the apparatus. The upper surfaces of the columns support the stack of sheets at the stacker station. Interspaced between the table carrying columns are a series of lateral belt conveyors driven by a motor through a series of rollers. The belt conveyors discharge sheets in a batch onto a discharge table surface after the upper carrying surfaces of the table have descended beneath the level of the conveyor belts.

Karis (U.S. Pat. No. '995) discloses a continuous sheet feeding machine provided with a sheet collection area for receiving and stacking sheets into either ream or skid loadings. Two separate scissor type lift tables and discharging devices are provided for the two types of piling methods. Motor driven screw arrangements shuttle the different lift tables into their proper positions. The ream table has a table base portion secured to the ream collection frame and a vertically movable table top portion on which a ream size pile of sheets can be collected in the collection area. Scissor type lift means are suitably connected between the table base and table top to raise and lower the table top. The table top has a series of parallel, spaced apart platform surfaces which fit in the spaces between the discharge conveyor belts, such that, after a ream pile has accumulated on the table top, the ream pile may be transferred to the discharge conveyor belts by lowering the table top beneath the level of the belts. The conveyor belts than draw the ream pile off the table top.

Bean describes an offset stacker having a frame provided with a tray located therein which is movable between an upper stacking station and a lower discharge station. Movable jogger arms aid in accumulating sets of sheets on the tray in an offset manner at a loading station. The tray is moved down to the discharge station by a pulley device to present stacked materials for removal from the stacker. The tray includes cutouts in registry with rollers so that the rollers may protrude above the tray at the discharge station.

Bean et al. teaches a paper handling system for use with a duplicating machine. Paper sheets are collected into sets and are transported to a finishing station where they are bound into pamphlets. The sheets are then stacked on a tray at a stacking station and moved to a discharge station. A discharge conveyor transports stacked sheets to a shelf for removal. The discharge station includes a discharge conveyor system which consists of a pair of belts which may run from the tray to the end of the discharge station. Rollers located within the stacker, extend upwardly through the tray to displace a stack of pamphlets to the conveyor system.

Daughton et al. discloses an elevator position control apparatus that maintains a copy sheet support surface within an established range in order to uniformly stack copy sheets on the support surface.

Sadwick et as. describes a sheet stacking apparatus which includes a tray that receives sets of copy sheets at a loading station and moves the sets of copy sheets to a discharge station. At the discharge station, the sets of copy sheets are transferred to a drawer. The drawer moves the sets of sheets from a discharge station to an unload station. As the sets of sheets are being unloaded from the drawer, additional sets of sheets are being loaded on the tray.

SUMMARY OF THE INVENTION

In accordance with an aspect of the present invention, there is provided a printer having a sheet stacking apparatus that is capable of stacking sets of a wide variety of copy sheet sizes and weights. The sheet stacking apparatus includes a two corner container that enhances the sheet stacking apparatus by providing copy sheet set at a time removal by way of one of open areas of the structure instead of having to lift the copy sheet set over the top of the container. A cover interlocks with the containers for storage and transporting purposes and provides four corner and top stack protection; lead in ramps for ease of assembly; common mounting hole configuration in the top of the cover which will ensure stabilized stacking capability and windows for stack viewing.

Other aspects of the present invention will become apparent as the following description proceeds and upon reference to the drawings in which.

While the present invention will hereinafter by described in connection with preferred embodiments, it is intended to cover all alternatives, modifications, and equivalents, as may be included within the spirit and scope of the invention as defined by the appended claims.

Figure 1:
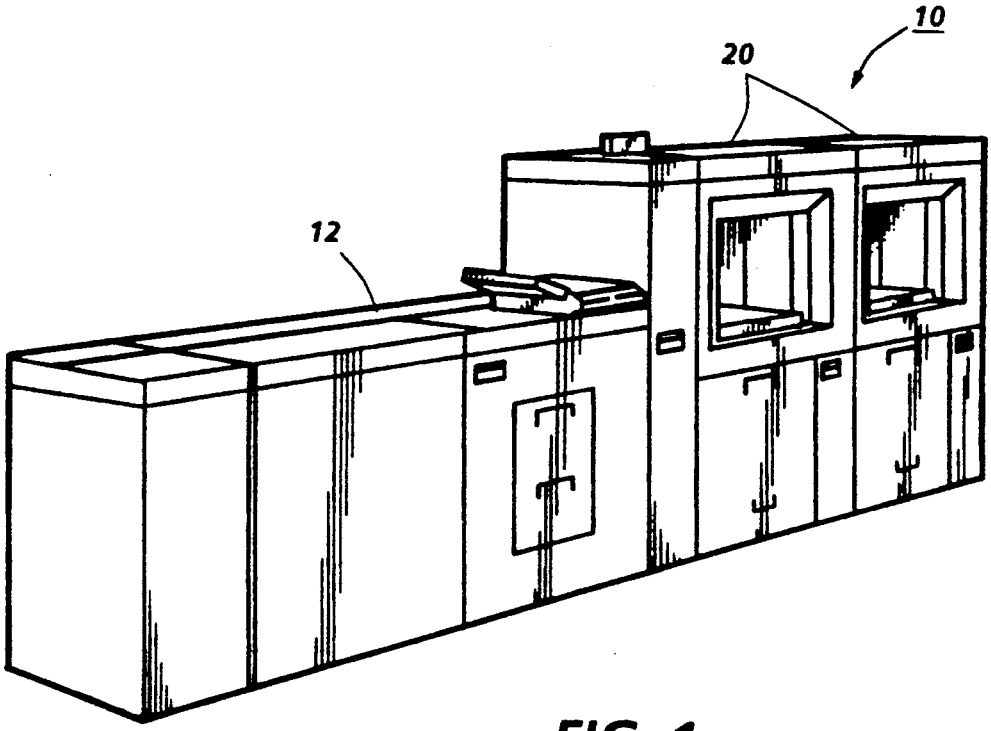
FIG. 1 is an isometric view of a printing machine incorporating the sheet stacking apparatus of the present invention.

For a general understanding of the features of the present invention, reference is made t the drawings. In the drawings, like reference numeral shave been used throughout to identify identical elements, FIG. 1 schematically depicts an electrophotographic printing machine incorporating the features of the present invention therein. It will become evident from the following discussion that the sheet stacking apparatus of the present invention may be employed in a wide variety of devices and is not specifically limited in its application to the particular embodiments depicted herein.

DETAILED DESCRIPTION OF THE PREFERRED EMBODIMENT

Figure 2:
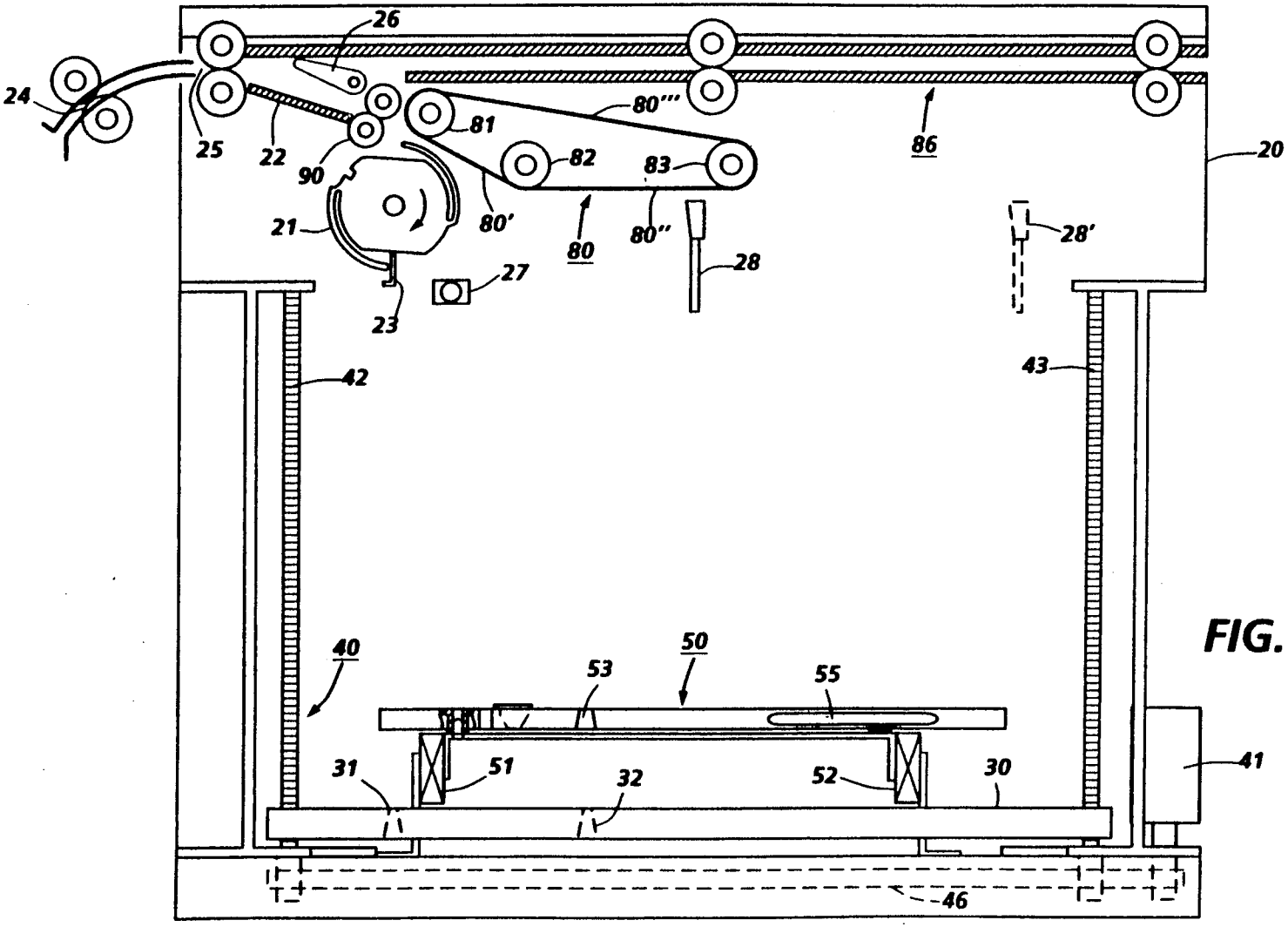
FIG. 2 is a side view of the sheet stacking apparatus of the present invention showing a main pallet in its home position.

FIGS. 1 and 2 illustrate a feeder/stacker 10 which includes two sheet stackers 20 according to the present invention. Feeder portion 12 can be, for example, a conventional high speed copier or printer. One type of system usable as feeder portion 12 can include an optical scanner for digitizing data contained on original documents and supplying the digitized data to a high speed, high quality printer such as a laser printer which outputs documents to the sheet stackers 20. Each sheet stacker 20 includes a rotating disk 21 which includes one or more slots for receiving sheets therein. Rotating disk 21 then rotates to invert the sheet and register the leading edge of the sheet against a registration means or wall 23 which strips the sheet from the rotatable disk 21. The sheet then drops to the top of the stack of inverted sheets which are supported on either a main pallet 50 or container pallet 58, both of which are vertically movable by elevator 30. An overhead trail edge assist belt system 80, to be described in more detail below, is located adjacent the rotatable disk 21 and above elevator platform 30 to assist in the inversion of sheets. Elevator platform 30 is moved in a vertical direction by the actuation of a screw drive mechanism 40. The screw drive mechanism includes a separate, vertical, rotatable shaft having a threaded outer surface at each corner of the elevator platform and extending through a threaded aperture therein (four vertical shafts in total). As the vertical shafts 42–45 are rotated by motor, platform 30 is raised or lowered. A stack height sensor 27, described below, is used to control the movement of platform 30 so that the top of the stack remains at substantially the same level. Each stacker 20 also includes a tamping mechanism (not shown) which is capable of offsetting sets of sheets in a direction perpendicular to the process direction.

The provision of more than one disk stacker 20 enables sheets to be outputted at higher speeds and in a continuous fashion. A specific requirement of the high speed computer printer market is the ability to provide long run capability with very minimal down time due to system failures, lack of paper supply, or lost time during unload. By providing more than one stacker, the outputting of documents need not be interrupted when one of the stackers becomes full since documents can merely be fed to the other stacker while the full stacker is unloaded. Thus, should one stacker become filled or break down, the outputting of copy sheets is not interrupted. Furthermore, the bypass capability (deflector 26 and bypass transport 86) of each stacker enables both stackers to be bypassed so that documents can be fed to other downstream devices such as additional stackers or sheet finishing apparatus, such as, for example, folding or stapling devices.

A trail edge guide 28 is positioned and movably mounted so that sheets having different lengths can be accommodated in sheet stacker 20. FIG. 2 illustrates the position of trail edge guide 28 for smaller sheets such as $8\frac{1}{2}\times 11''$ sheets (long edge fed). The position of trail edge guide 28' is shown for sheets that are $11\times 17''$ (short edge fed).

Before entering sheet stacker 20, the sheets exit through output nips 24 and 25 of an upstream device. The upstream device could be a printer, copier, other disk stacker, or a device for rotating sheets. Sheets may need to be rotated so that they have a certain orientation after being inverted by disk 21. The sheets can enter disk stacker 20 long edge first or short edge first. After entering stacker 20, the sheet enters predisk transport 22 where the sheet is engaged by the nip formed between one or more pairs of disk stacker input rollers 21. If a bypass signal is provided, bypass deflector gate 26 moves downward to deflect the sheet into bypass transport assembly 86. If no bypass signal is provided, the sheet is directed to disk input rollers 90 which constitute part of the feeding means for feeding sheets to an input position of disk 21.

The movement of the disk 21 can be controller by a variety of means conventional in the art. Preferably, a sensor located upstream of disk 21 detects the presence of a sheet approaching disk 21. Since disk input nip 21 operates at a constant first velocity, the time required for the lead edge of the sheet to reach the disk slot is known. As the lead edge of the sheet begins to enter the slot, the disk rotates through a 180° cycle. The disk 21 is rotated at a peripheral velocity which is about ½ the velocity of input rollers that form input 25 so that the leading edge of the sheet progressively enters the disk slot. However, the disk 21 is rotated at an appropriate speed so that the leading edge of the sheet contacts registration wall 23 prior to contacting the end of the slot. This reduces the possibility of damage to the lead edge of the sheet. Such a manner of control is disclosed in above-incorporated U.S. Pat. No. 4,431,177 to Beery et al.

One advantageous feature of the present invention involves the construction and operation of trail edge transport belt 80. As opposed to previous systems which utilized a trail edge transport belt which operates at the same velocity as the feeding means which inputs sheets into the rotatable disc, the present invention includes a trail edge assist belt or belts 80 which are rotated at a velocity which is greater than the velocity at which feeding means (which includes input nips 24 and 25) is operated. Preferably, transport belt 80 is rotated at a velocity which is 1.5 times the velocity of the feeding means. Additionally, trail edge transport belt 80 is arranged at an angle to elevator platform 30 so that a distance between a portion of the transport belt and elevator platform 30 decreases as the transport belt 80 extends away from rotatable disk 30. Three pulleys 81, 82, and 83, at least one of which is driven by a motor (not shown) maintain tension on transport belt 80 and cause transport belt 80 to rotate at a velocity which is greater than that of the feeder means. Transport belt 80 is configured and positioned with respect to disc 21 to ensure that all sheets including lightweight sheets begin to make contact with the belt 80 while each sheet is being driven by input nip 25. After the trail edge exits the input nip, the sheet's velocity will be at the direction required to un-roll, the sheet will un-roll and force it to not sag away from the transport belt increasing the reliability of the stacker. That is, after the lead edge of the sheet has been inverted by discs 21, a sheet has to un-roll its trail edge to finish inverting. Previously, a set of flexible belts were rotated near the top of the discs and angled downwardly toward elevator platform 30. The belts would assist the sheet to un-roll if the sheet contacts the belts. The problem with this design is that lightweight 3 pitch sheets do not always have enough beam strength to contact the belts. They sag away from the belts and without velocity at the direction required to un-roll, and therefore fail to invert their trail edges.

Figure 5:
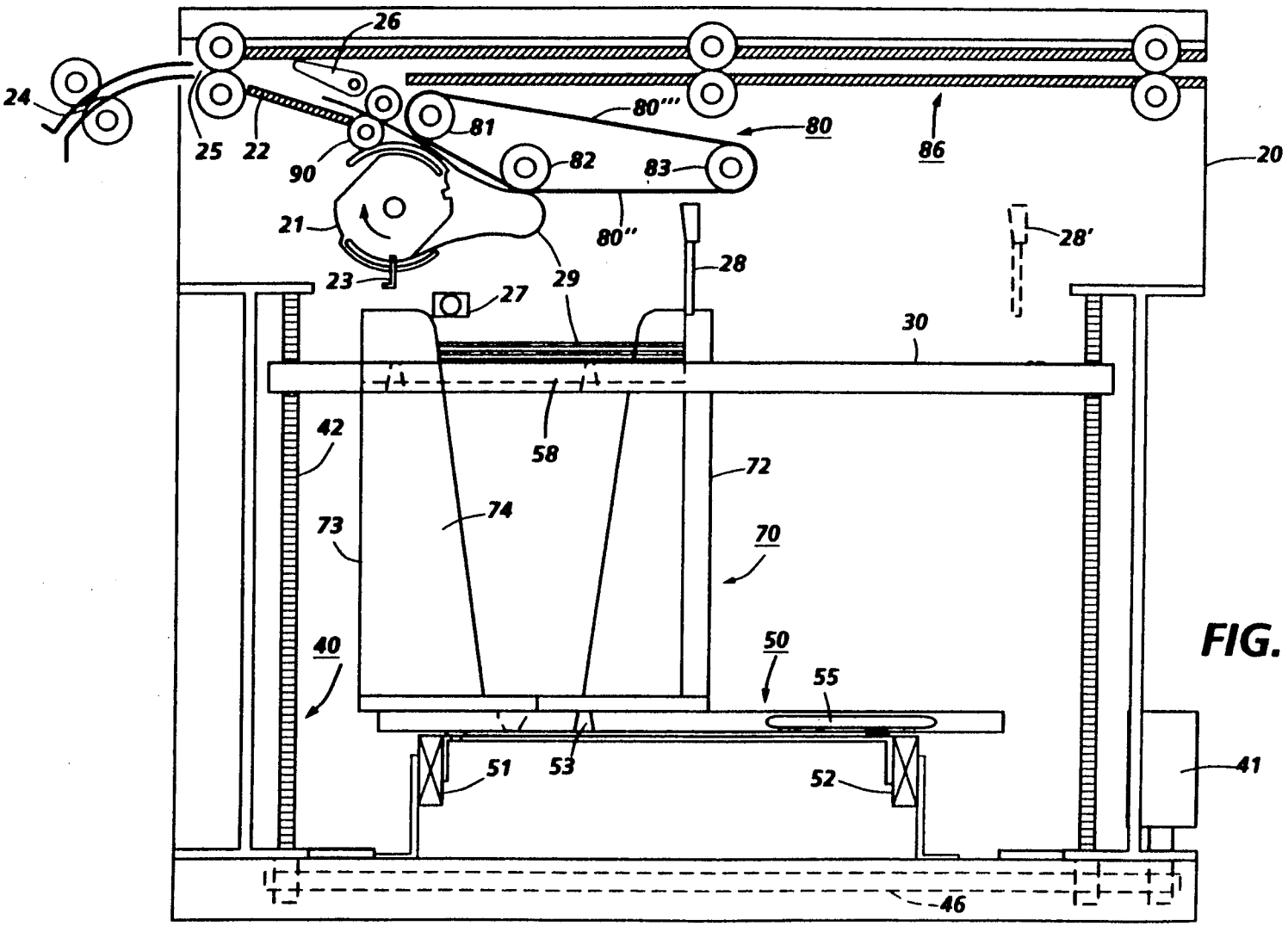
FIG. 5 is a side view of the sheet stacking apparatus of the present invention showing a container on the main pallet with its container pallet lifted into a sheet stacking position by an elevator mechanism.

This problem is solved and additional reliability in handling light weight sheets is obtained by configuring belt 80 such that a section 80' thereof is closely spaced with respect to discs 21 and slopes downwardly at a steep angle in a span between rollers 81 and 82 as it extends away from discs 21. This configuration facilitates control for the sheet in that the sheet contacts the belt while it is still in input rollers 90. A second portion 80'' of belt 80 is parallel to the top surface of elevator 30 while a third portion of the belt 80''' is at an acute angle with respect to elevator 30 that is less than the acute angle of slope 80'. With this structural relationship between belt 80 and disc 21, control is maintained over sheets 29 of all sizes and weights because the sheets are forced to contact belt(s) 80 while they are still under the influence of input rollers 90 as shown in FIG. 5 and, as a result, contact with the belt is maintained as the disc is rotated and the sheet continues to un-roll as required. Belt 80 is configured as an inverted triangle with the apex 82 of the triangle being downstream from disc 21 and positioned below a plane across the uppermost portion of the disc. A portion of the belt most remote from the disc is an uninterrupted straight span that is angled downwardly with respect to a horizontal plane.

Figure 3:
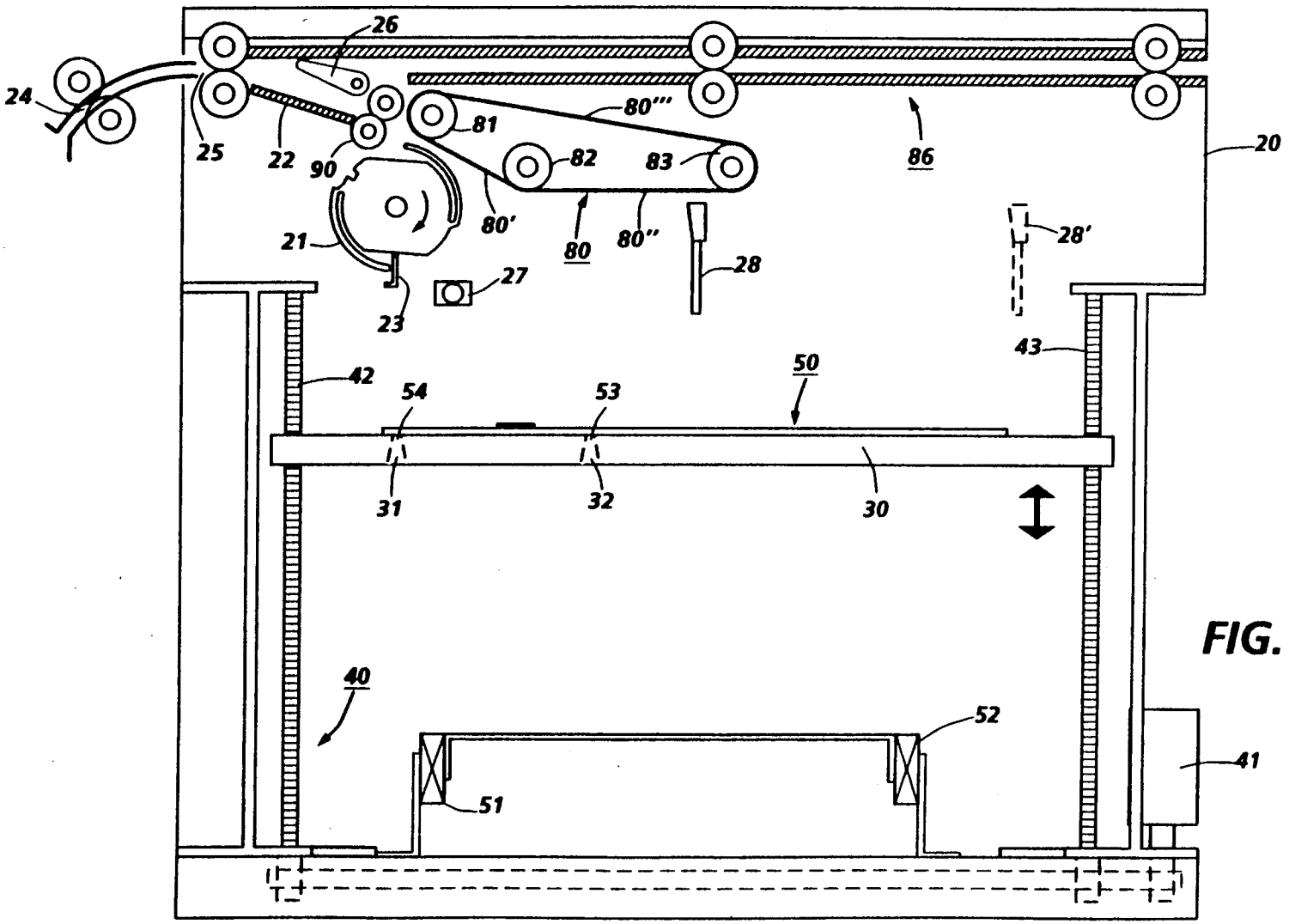
FIG. 3 is a side view of the sheet stacking apparatus of FIG. 2 with the main pallet in a raised position.
Figure 3A:
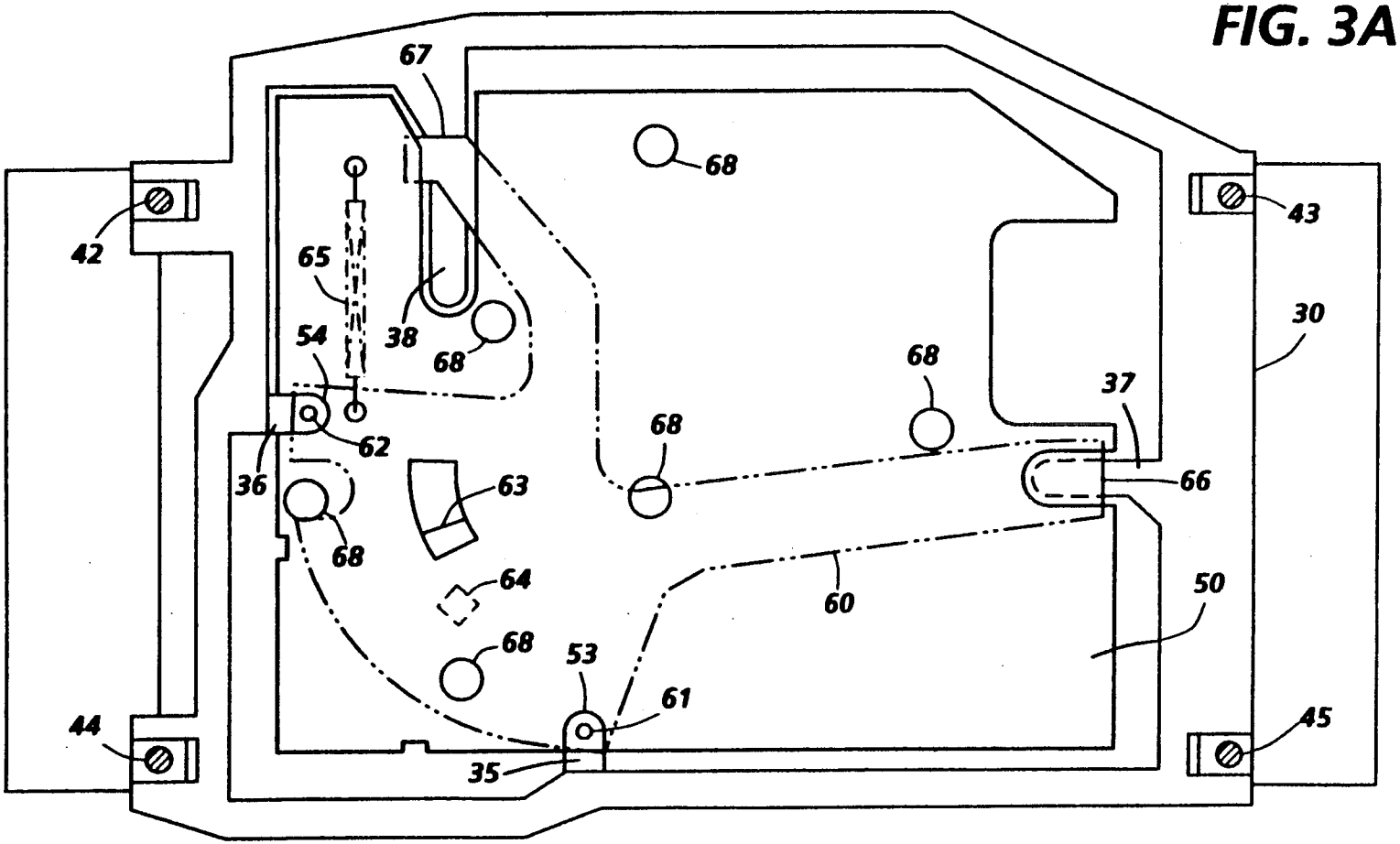
FIG. 3A is a plan view of the sheet stacking apparatus of FIG. 2 showing a spider latch in phantom in an unactivated position which facilitates movement of the main pallet by an elevator mechanism.

As indicated by the arrow in FIG. 3, before the first sheet comes into stacker 20, motor 41 is energized by a conventional controller and raises elevator 30 by way of screws 41, 42, 43 and 44. Elevator 30 has projections 31 and 32 therein that are configured to fit into openings 53 and 54 of main pallet 50 as well as openings 61 and 62 in spider latch 60 when the spider latch is in the unactuated position as shown in dotted lines in FIG. 3A and indicated by pointer 63. Portions 66 and 67 of spider latch 60 are also used to raise the pallet by container arms 37 and 38 of elevator 30. Once the main pallet 50 is in its uppermost position, sheets are stacked thereon by disc 21 of stacker 20. A conventional photosensor 27 that includes an emitter and receiver monitors the sheet stack height and through signals to a controller in printer 12, indexes the pallet downward in response to the receiver being blocked by the top of the sheet stack. When feeding of sheets into stacker 20 is complete, handle 55 is grasped and main pallet 50 is withdrawn from the stacker using rails 51 and 52 and sheets are removed from the main pallet for further processing. While this process is taking place copy sheets are forwarded to a second stacker for stacking.

Figure 6:
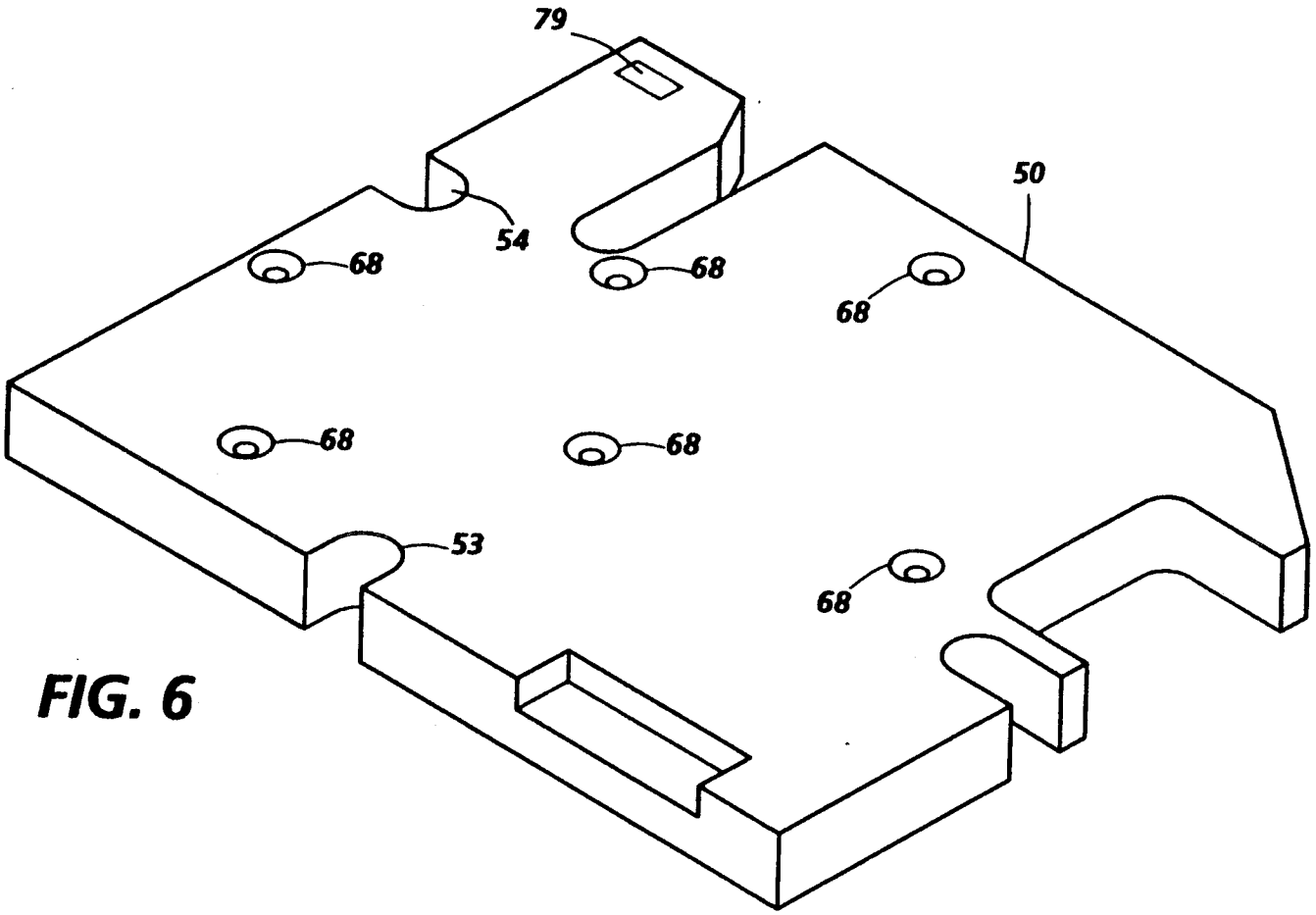
FIG. 6 is a schematic isometric view of the main pallet of the sheet stacking apparatus of FIG. 2.

With continued reference to FIG. 3, there is shown further details of the manner in which elevator 30 is indexed. As shown in FIG. 2, elevator 30 has tray or pallet 50 as in FIG. 6 mounted thereabove for the support of copy sheets. With continued reference to FIG. 3, drive motor 41 is a bi-directional 115 Volt AC motor that raises and lowers elevator 30. A 100 millisecond delay is required before reversing the motor direction. The motor capacitor ensures that the motor starts and runs in the correct direction. In order to protect the motor against damage caused by the complete or partial seizing of the elevator 30, the motor contains an internal sensor. If the motor becomes too hot, the sensor switches off the motor. The thermal sensor resets automatically when the motor cools. When the motor 41 is switched ON in order to raise or lower elevator 30, the elevator 30 is moved by a drive belt 46. One drive belt 46 connects the drive from motor 41 to the four lead screws 42–45. A spring (not shown) attached to the motor and frame applies tension to the drive belt. Elevator 30 is connected to the four lead screws by lift nuts (not shown). Two triacs mounted on a remote board are associated with the motor. One triac is used to raise elevator 30 with the other being required to lower elevator 30. In response to a high signal from stack height switch sensor 27, the control logic sends a 5 volt signal to the triac. The triac then sends AC power to the motor 41 and capacitor and switches ON motor 41 for a predetermined number of milliseconds. Afterwards, the control logic switches off the 5 volt signal to the triac so as to de-energize motor 41. The pitch of the lead screws is selected so that the predetermined millisecond rotation of the lead screws will translate elevator 30 a fixed preselected distance in millimeters.

Figure 5A:
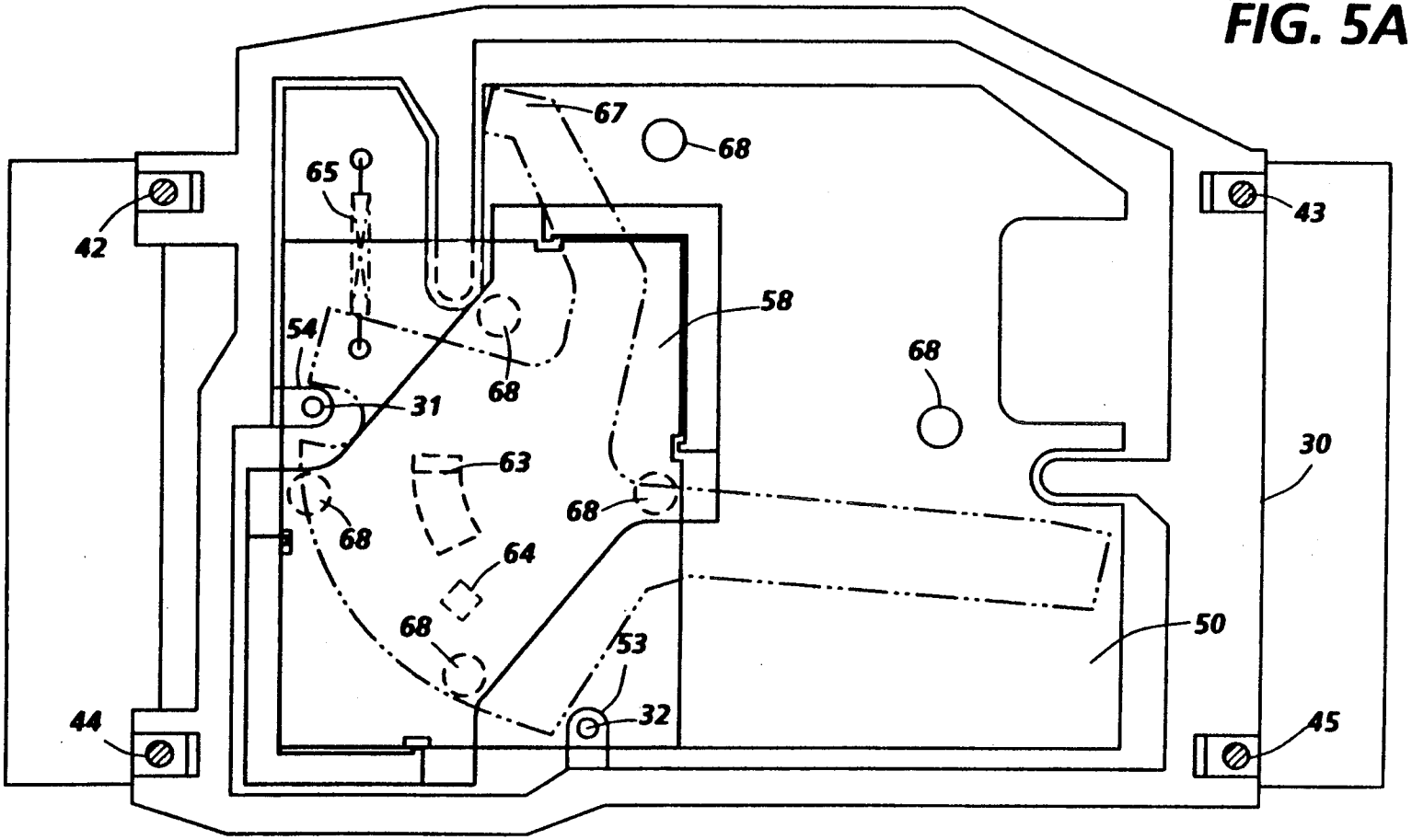
FIG. 5A is a plan view of the sheet stacking apparatus of FIG. 5 showing the spider latch mechanism in its actuated position in phantom which allows the elevator mechanism to lift the container pallet.
Figure 8:
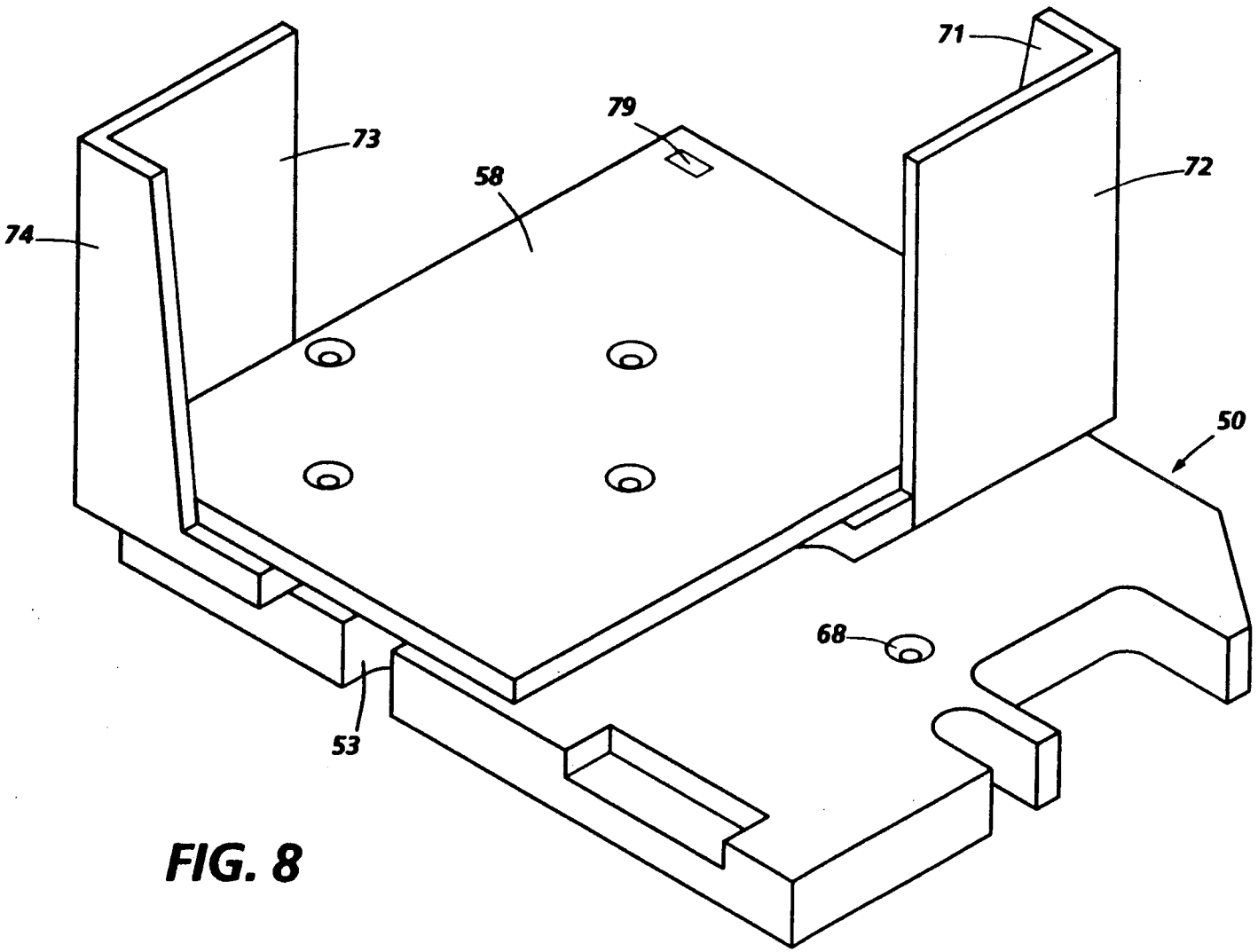
FIG. 8 is a schematic isometric view of a container and container pallet for $8\frac{1}{2}'' \times 11''$ sheets mounted on the main pallet.

Alternatively, for ease of removal of a stack of sheets from the main pallet and storage, a container pallet 58 of FIGS. 5A and 8 is placed on top of main pallet 50. Container pallet 58 has projections on the bottom thereof that mate with complimentary openings 68 in main pallet 50. Placing of container pallet 58 onto main pallet 50 will cause the weight of container pallet 58 to actuate spider latch 60 by pressing it out of engagement with ramp 64. Once this happens, spring 65 pulls the spider latch to the dotted line position shown in FIG. 5A and indicated by pointer 63. With the spider latch in this position, elevator 30 will lift the container pallet into position to receive sheets and not the main pallet 50 since arms 35 and 36 will now pass through openings 53 and 54 of the main pallet and contact the bottom of container pallet 58 and lift the pallet to the sheet receiving position. The stacker is emptied by lifting the container pallet off the main pallet. Container pallets are sized according to the size of sheets to be stacked and projections on the bottom of the container pallets fit into those of the openings in the main pallet as appropriate.

Figure 9:
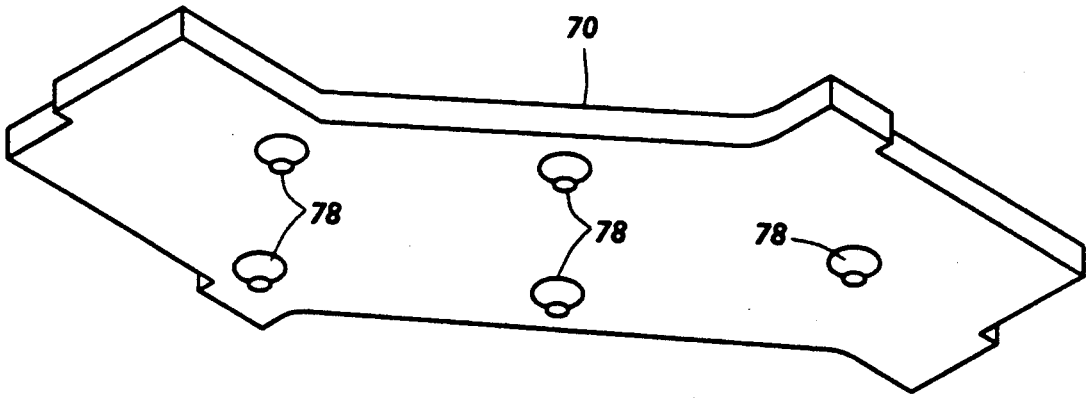
FIG. 9 is a partial schematic isometric view of the container in FIG. 5 showing projections on its bottom surface that mate with complimentary openings in the main pallet.
Figure 4:
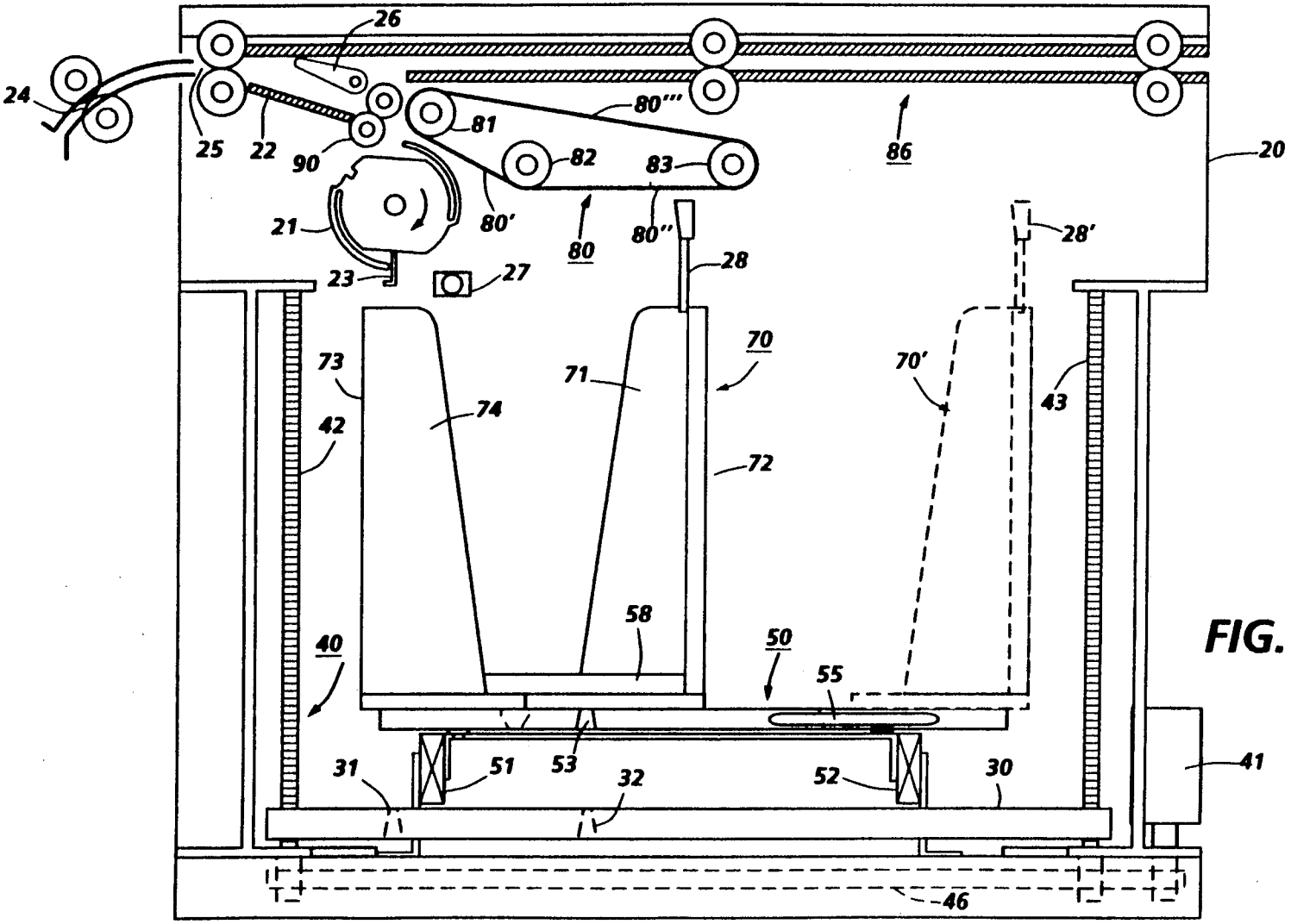
FIG. 4 is a side view of the sheet stacking apparatus of FIG. 2 showing a container for stacking $8\frac{1}{2}'' \times 11''$ sheets in solid lines and a container for $11'' \times 17''$ sheets in dotted lines, both positioned on the main pallet with one showing a container pallet as an insert.
Figure 7:
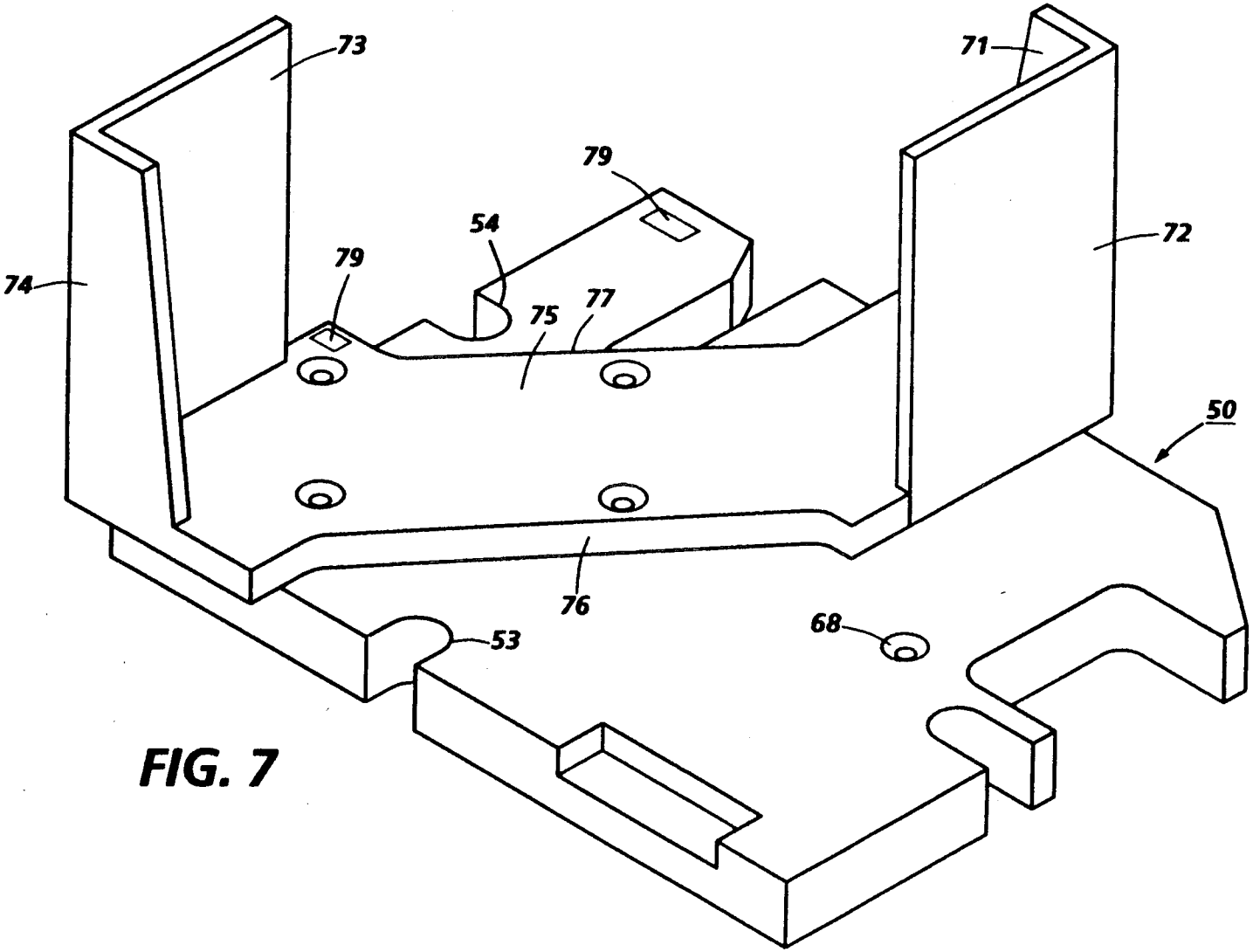
FIG. 7 is a schematic isometric view of a container mounted on the main pallet of FIG. 6.

The preferred embodiment of the present invention is shown in FIGS. 4, 7 and 8 that includes containers 70 and 70' in position to receive sheets for stacking. Container 70 is sized to receive $8\frac{1}{2} \times 11''$ sheets while dotted line container 70' is sized to receive $11 \times 17''$ sheets. Containers are sized to accommodate sheet sizes from B5 to A3 and each size will fit onto main pallet 50. Each container has a container pallet 58 therein that is lifted to a stack loading position by elevator 30. Each container has magnets attached to one surface thereof that are used to signal the printer's controller as to the size of containers in place. Main pallet 50 and container pallet 58 also have magnets 79 attached thereto that signal the controller while apparatus is being used as a sheet stack support. Container 70 is shown in its unloaded position in FIG. 4 and in position to receive sheets in FIG. 5 with container pallet 58 in a raised position. As seen in FIGS. 5, 5A and 9, container 70 includes a container pallet and has a support surface with relieved areas and only two diametrically opposite corners which provide the advantages over four corner containers of: (1) allowing multiple size containers to be used with the same elevator lift mechanism; (2) allowing improved visibility from any angle for determining stacking progress within the printer by checking the status of the containers (full or empty) outside the printer; (3) providing a symmetrical (identical) corner design which allows one mold for both corners and is common for all container sizes; (4) allows for improved container nesting for storage and shipping; (5) providing separate container floor and corners which allow dissembled shipment for improved nesting; (6) allows for set removal via an open corner instead of lifting copy sheets over the top of the container thereby improving overall operability; and (7) allows access to lift the entire stack of sheets from the container without the use of an unload pedestal as heretofore required.

Container 70 in FIGS. 7 and 8 in order to meet the heretofore mentioned advantages comprises a base support member 75 that has two relieved or cut-away portions 76 and 77 therein leaving only two right angled corners that are opposite each other. Upstanding side members 71, 72, 73 and 74 are connected to the two corners of the base member to allow several reams of copy sheets to be stacked on container pallet 58 which is positioned on base member 75. Each container size, i.e., for $8\frac{1}{2}\times11''$, $11\times17''$, etc. is oversized by about $\frac{1}{2}''$ in order for each copy sheet set including tab stock within the container walls to be offset by conventional side joggers. Sides 71, 72, 73 and 74 each slope downwardly and outwardly from top to bottom to provide open viewing of sheets in the container. The copy sheet stacking container of FIG. 7 which includes upstanding side walls 71, 72, 73 and 74 rests on main pallet 50. A container pallet 58 rests on the bottom surface or base 75 of the container as shown in FIG. 8. The side walls 71, 72, 73 and 74 are not raised when elevator 30 is actuated since spider latch 60 is in the position shown in FIG. 5A which facilitates arms 35 and 36 of the elevator passing through openings 53 and 54 of main pallet 58. Arms 35 and 36 contact the container pallet 58 and lifts only it up to the position shown in FIG. 5 to receive incoming sheets. Lifting only container pallet 58 is made possible because the weight of the container placed onto the main pallet will cause the spider latch 60 to move to the position shown in FIG. 5A which allow arms 35 and 35 to pass through openings 53 and 54 of main pallet 58.

As shown in FIG. 9, container 70 has projections 78 on the bottom surface thereof that mate with opening 68 in the main pallet and releases latch 60 due to the weights of the container on the main pallet. The projections also provide stability and precise, predictable positioning of the container.

Figure 10:
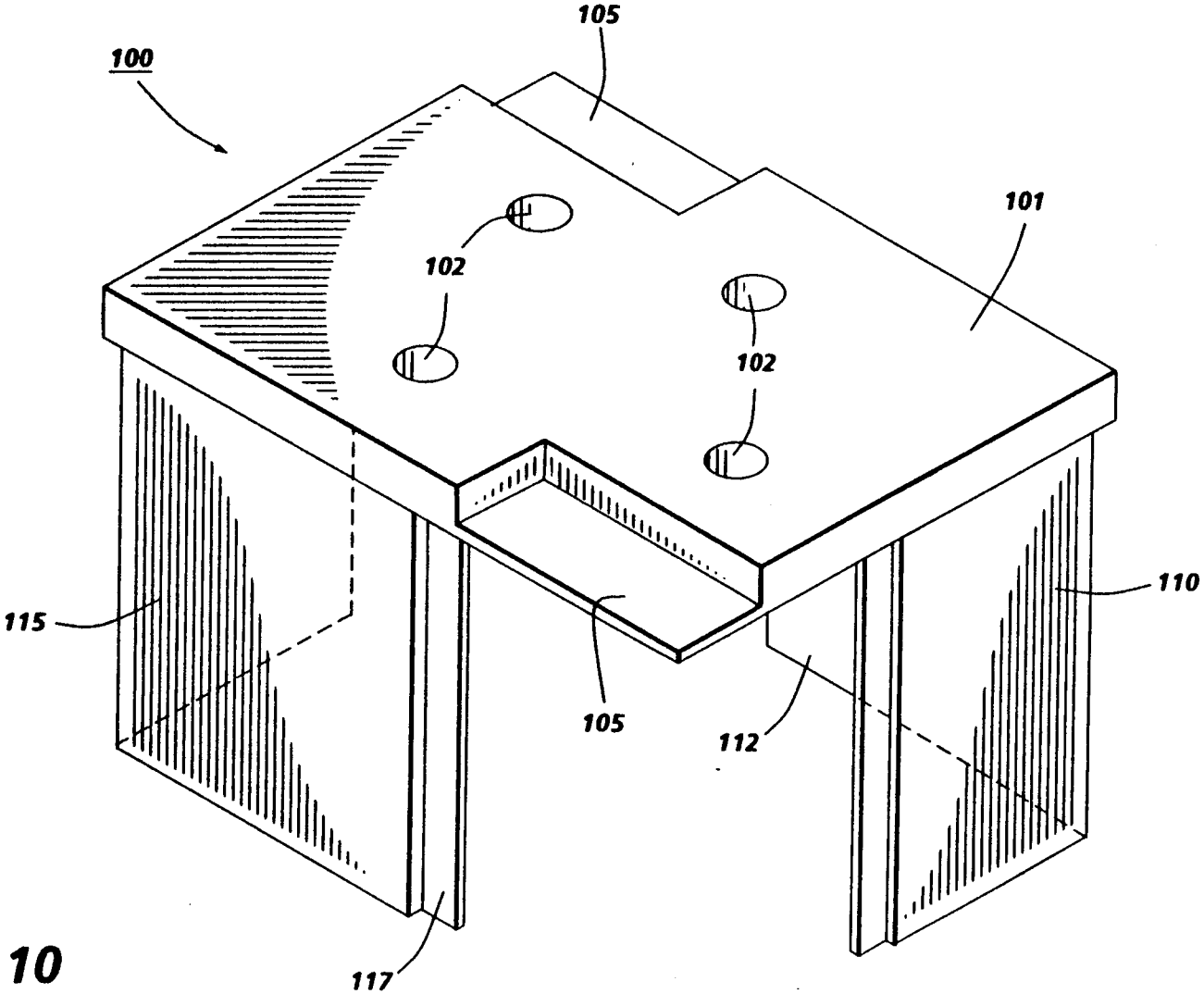
FIG. 10 is a schematic isometric view of a container cover adapted to be mounted onto a container.
Figure 11:
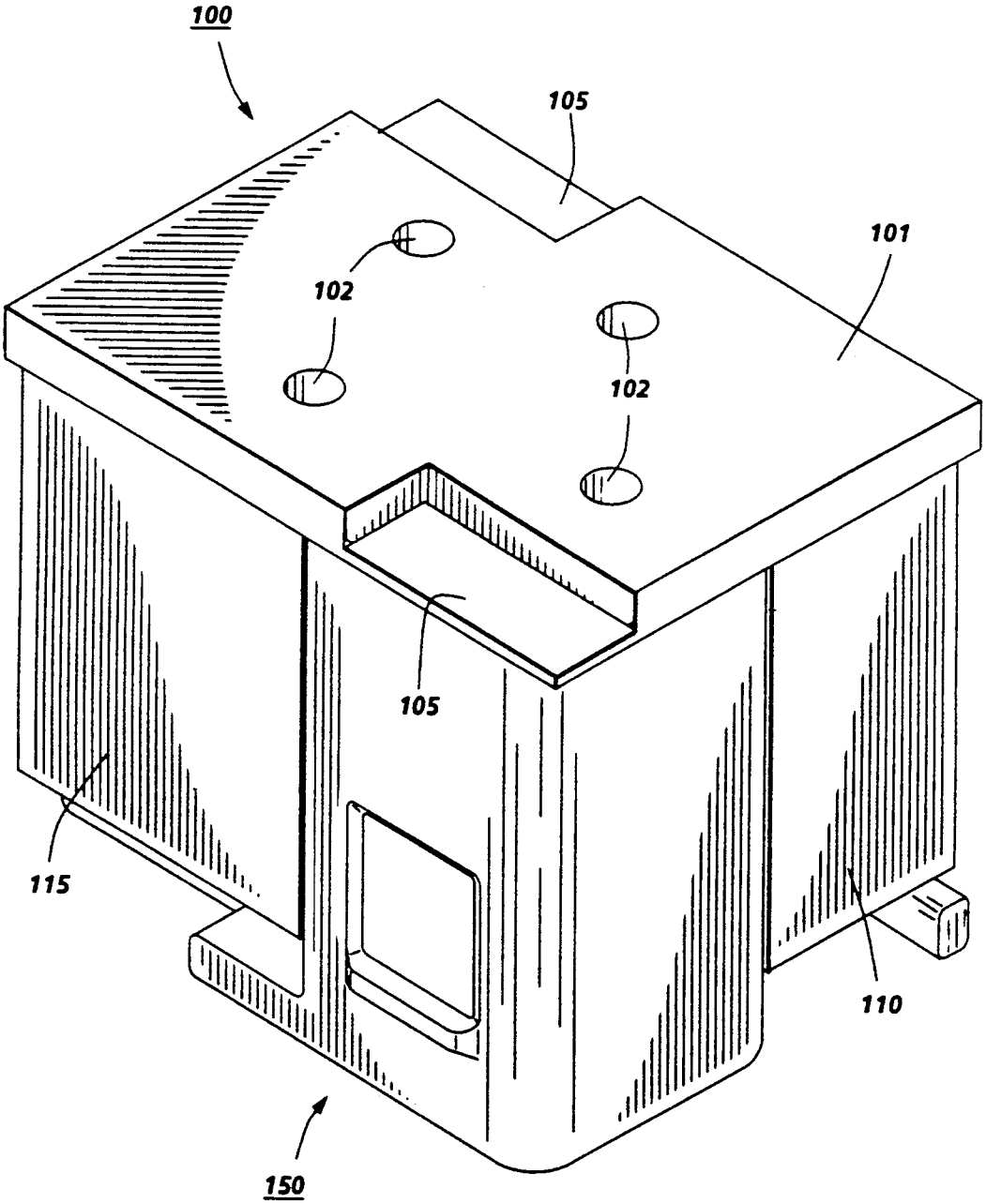
FIG. 11 is a schematic isometric view of a container and a cover mounted on the container for storage, stacking and transporting purposes.

A cover 100 is shown in FIGS. 10 and 11 which provides enclosed stacking for protection of the copy sheet stacked in containers 70 and 70'' of FIGS. 4, 7 and 8 and container 150 of FIG. 11 for the protection of the output stack during storage, transportation and handling. In addition, cover 100 interlocks with each container to provide: four corner and top paper stack protection; lead in ramps for ease of assembly of the covers; a common mounting hole configuration in the top of the cover that compliments protrusions extending from the bottom of the container which will ensure stabilized stacking of a plurality of containers; and open areas or windows for viewing the stack when necessary. If desired, the cover can be extended to allow environmental protection by having the cover fully seal the stack within the container and cover.

In FIG. 10, container cover 100 is comprised of a flat rectangular member portion 101 that has holes 102 therein in a predetermined pattern that are configured to accept projections on the bottom of sheet stack containers for stabilization of the container on top of the cover portion 101. Container top portion 101 has cutout finger lift clearance areas 105 at opposite ends thereof that that facilitate the stacking of containers and lifting containers off of other containers are positioned directly over a lift handle of a container. Side members 110 and 112 extend downward from rectangular portion 101 and forms a corner therewith. At the opposite end of the rectangular member, side members 115 and 117 are attached and extend downward therefrom to form a second corner with the rectangular member. Each of the sides have recessed or relieved portions that compliment recesses in a container which makes for a smooth appearance of the outside surfaces of a cover and container.

A container cover 100 has been placed over output stack container 150 in FIG. 11 and is now ready for a second container to be placed on top of it. Each container has projections or protrusions extending from the bottom thereof that are in a pattern that matches the pattern of holes 102 in container cover 100 so that once a container 150 is placed on top of another container it fits uniformly and securely on top of the cover due to the projections on the bottom of the container and the holes in the top of cover 100. The side members that form two opposite corners of cover 100 are positioned opposite to sides that form two corners of container 150 so that when the container cover is placed over the container, the recessed portions of sides 110, 112, 115 and 117 fit inside recess portions in the sides of container 150.

It should now be apparent that a stacker apparatus has been disclosed that can handle all sizes for sheets and all sizes of containers as opposed to previous stackers that used only one container for multiple sized sheets. For all different sizes, the present sheet stacker operates in three different modes. In a first mode of operation, sheets are stack directly on the main pallet. In a second mode of cooperation, sheet are stacked on the container pallet without the container. And in a third mode of operation, sheets are stacked on a container pallet which is positioned within a container with the container being placed onto the main pallet. In either mode of operation the main pallet slides out for unloading and is raised and lowered by an elevator mechanism to facilitate the stacking function. The main pallet has a four point lift frame which is used for all sheet stacking directly onto a predetermined pallet. When the container and its pallet are used, a spider latch is rotated to allow the lift frame of the elevator to pass through the main pallet and lift the container pallet. A stacking cover mates with the two corner copy sheet container to provide four corner protection and container stacking capability for storage and/or transportation of output stacks from the machine.

In general summary, copy sheet output from a printer is handled in low cost, removable, plural, interchangeable, multiple job-handling projection, side walls, job stacking containers, with an added false-bottom stacking platform, which stacking platform is automatically disengagable from lifting and stack height control means therefor which are left inside the printer itself. The containers allow offset stacking therein, on the lifted false bottom, registered by end and side joggers in the machine, not in the bins, then allows removal of the whole stack of offset jobs in and with the containers, for processing off-line, while another container is being inserted, and the container in the next stacker module is being filled by an automatic switch over of the output to the next module or stack apparatus with no pitch loss. There are different size bins for different sized of sheets, with "key" means on each container for automatically encoding/signaling the printer the container size information, and signaling the presence of an optional container rather than just the main pallet or signaling that a container pallet alone is being used as the sheet stacking platform as opposed to the main pallet. A cover provides enclosed stacking for protection of the output stack during transportation and handling and is adapted to also facilitate stacking of containers thereon for storage purposes.

It is, therefore, evident that there has been provided, in accordance with the present invention, an apparatus that fully satisfies the aims and advantages hereinbefore set forth. While this invention has been described in conjunction with a preferred embodiment thereof, it is evident that any alternatives, modifications, and variations will be apparent to those skilled in the art. Accordingly, it is intended to embrace all such alternatives, modifications, and variations as fall within the spirit and broad scope of the appended claims.

We claim:

1. A container cover which provides four corner protection and stacking capability for a container that receives copy sheets from a source with the container including a bottom support member with the bottom support member having only two corners and walls connected to the two corners of the bottom support member to form two diametrically opposed sheet guide surfaces, comprising:

a flat, rectangular member, said flat, rectangular member having holes therein positioned in a predetermined pattern; and walls extending downwardly from said flat, rectangular member and forming two corners therewith that are positioned opposite to the diametrically opposed sheet guide surfaces of the bottom support member of the container so that when said container cover is placed on top of said container four corner protection and stacking capability of the container is provided.

2. The container cover of claim 1, wherein said flat, rectangular member includes recessed finger lift clearance areas at diametrically opposed corners thereof.

3. The container cover of claim 2, wherein said container has projections extending from its bottom surface that mate with said openings in said flat, rectangular member in order to stabilize said container and present a predictable positioning of said container on said flat, rectangular member for stacking purposes.

4. The container cover of claim 2, wherein said walls of said container cover and said container have complimentary recesses therein that mate when said container cover is positioned on top of the container in order to present a continuous, smooth outward appearance.

5. The container cover of claim 1, including means for interlocking said container cover with said container.

6. The container cover of claim 1, wherein said flat, rectangular member includes means for enhancing the stacking of a container thereon.

7. A container cover which provides four corner protection and stacking capability for a container that receives copy sheets from a source with the container including a bottom support member with the bottom support member having only two corners and walls connected to the two corners of the bottom support member to form two diametrically opposed sheet guide surfaces, comprising:

a top member having holes therein positioned in a predetermined pattern; and walls extending from said top member and forming two corners therewith that are positioned opposite to the diametrically opposed sheet guide surfaces of the bottom support member of the container so that when said container cover is placed on top of said container four corner protection and stacking capability of the container is provided.

8. The container cover of claim 7, wherein said top member includes means for lifting a container off of said top member at diametrically opposed corners thereof.

9. The container cover of claim 8, wherein said container has projections extending from its bottom surface that mate with said openings in said flat, rectangular member in order to stabilize said container and present a predictable positioning of said container on top of said container cover for stacking purposes.

10. The container cover of claim 8, wherein said walls of said container cover and said container have complimentary recesses therein that mate when said container cover is positioned on top of the container in order to present a continuous, smooth outward appearance.

* * * * *